United States Patent [19]

Gilvydis

[11] 4,454,799

[45] Jun. 19, 1984

[54] AMMUNITION STORAGE AND WEAPON LOADING SYSTEM

[75] Inventor: Jaunutis B. Gilvydis, Oakland, Mich.

[73] Assignee: The United States of America as represented by the Secretary of the Army, Washington, D.C.

[21] Appl. No.: 382,038

[22] Filed: May 26, 1982

[51] Int. Cl.[3] ..... F41H 7/06

[52] U.S. Cl. ..... 89/47; 89/34

[58] Field of Search ..... 89/25, 33 A, 33 B, 34, 89/36 H, 36 K, 45, 46, 47

[56] References Cited

U.S. PATENT DOCUMENTS

| | | | |
|---|---|---|---|
| 3,721,156 | 3/1973 | Schallehn | 89/36 K |
| 4,313,363 | 2/1982 | Schreckenberg | 89/46 |
| 4,318,331 | 3/1982 | Echtler et al. | 89/46 |
| 4,391,179 | 7/1983 | Tidstrom | 89/36 K |

FOREIGN PATENT DOCUMENTS

| | | | |
|---|---|---|---|
| 2543155 | 3/1977 | Fed. Rep. of Germany | 89/45 |
| 17595 | of 1913 | United Kingdom | 89/46 |

*Primary Examiner*—Stephen C. Bentley

*Attorney, Agent, or Firm*—Peter A. Taucher; John E. McRae; Robert P. Gibson

[57] ABSTRACT

In a tank or similar military vehicle having a main weapon located atop a rotary basket, the improvement comprising one or more ammunition storage magazines located within the vehicle hull behind the basket. Transfer mechanisms are employed to move individual rounds of ammunition from the storage magazines into a rammer located within the basket. The rammer moves the ammunition round upwardly into the firing chamber of the weapon. The system is designed to provide storage capacity for large numbers of ammunition rounds. Another design objective is to provide a transfer mechanism that accomplishes a weapon loading cycle in a relatively short time span.

7 Claims, 9 Drawing Figures

AMMUNITION STORAGE AND WEAPON LOADING SYSTEM

GOVERNMENT INTEREST

The invention described herein may be manufactured, used, and licensed by or for the Government for governmental purposes withiout payment to me of any royalty thereon.

BACKGROUND AND SUMMARY OF THE INVENTION

This invention relates to mechanism for storing individual rounds of ammunition in tanks or similar military vehicles. The invention is also concerned with automatic mechanism for transferring individual rounds of ammunition from the vehicle storage areas into the firing chamber of an external weapon located above the vehicle hull. The invention is intended especially for use with relatively large and heavy ammunition such as 120 mm rounds of the armor piercing or high explosive type. An object of the invention is to provide storage capacity for large numbers of rounds, e.g., forty rounds, in relatively nonexposed, nonvulnerable areas of the vehicle hull. Another object is to accomplish a weapon loading cycle within a relatively short time span.

THE DRAWINGS

Figure 9:
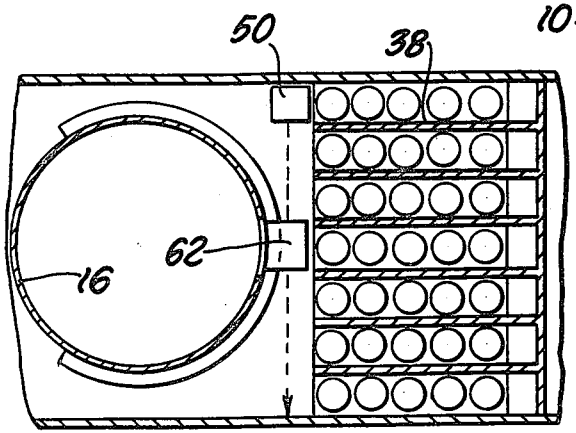

FIG. 9 schematically illustrates a second embodiment of the invention.

Figure 1:
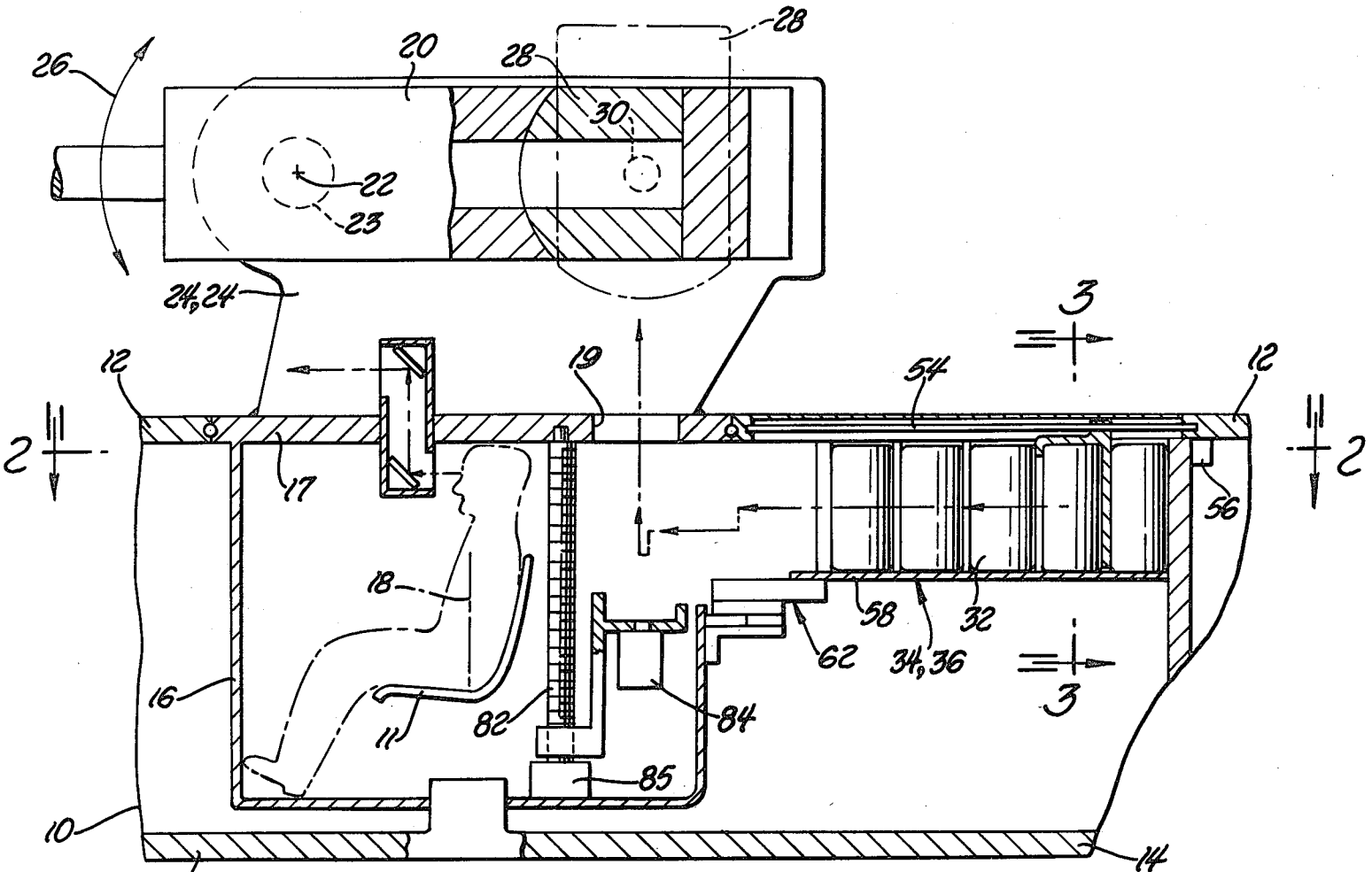
FIG. 1 is a longitudinal sectional view taken through a military vehicle equipped with one embodiment of my invention.
Figure 2:
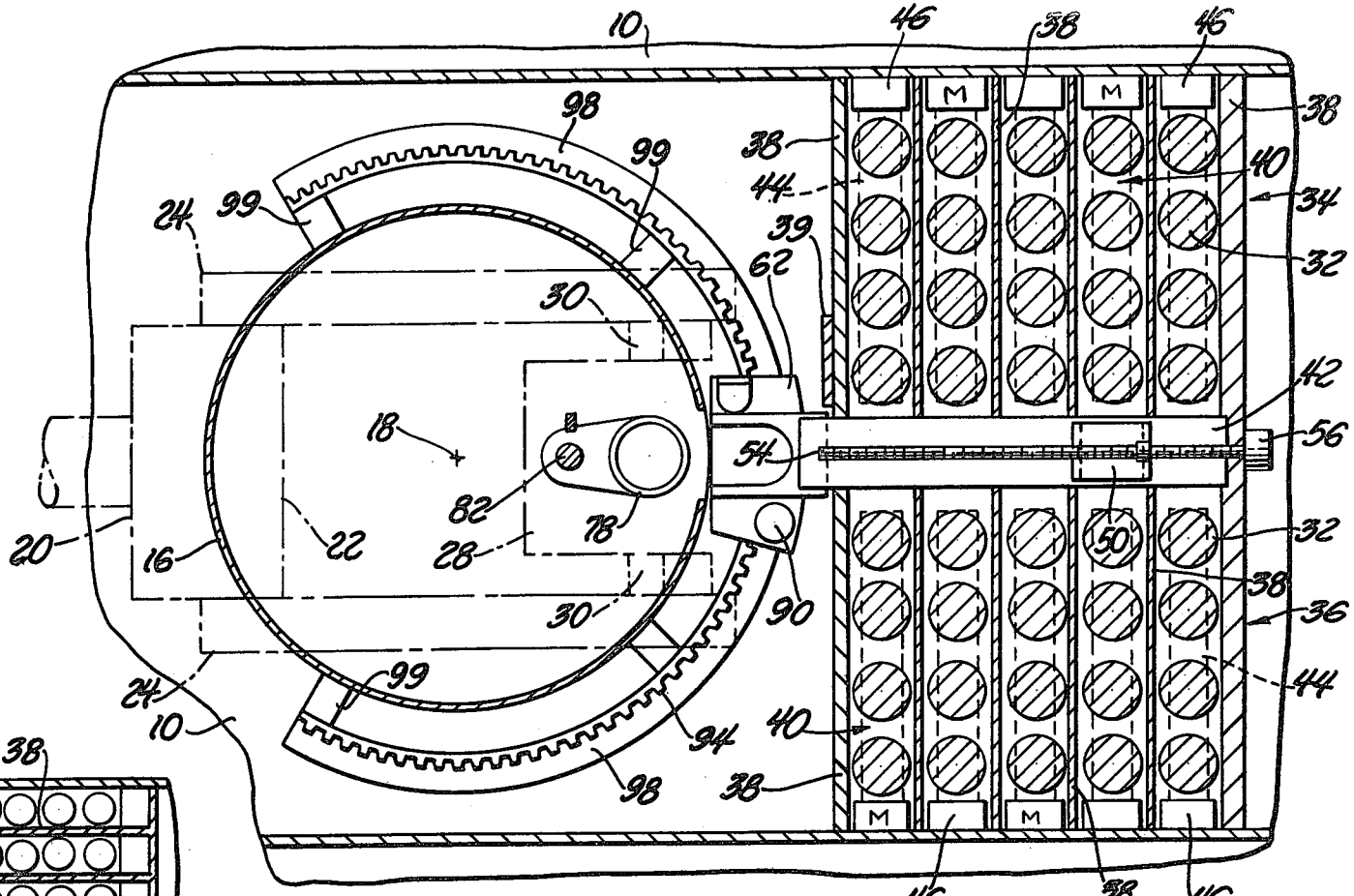
FIG. 2 is a sectional view taken generally along line 2—2 in FIG. 1.

Referring more particulrly to FIGS. 1 and 2, there is shown a preexisting military tank design that includes a hull 10 having an upper wall 12 and bottom wall 14. A circular basket 16 is located in the hull for three hundred sixty degree azimuth rotational motion around central axis 18. An external weapon 20 is mounted above the basket for adjusting motions around elevational axis 22. Weapon mounting means comprises two laterally spaced trunnion walls 24 extending upwardly from basket top wall 17, and trunnion pins 23 extending from the receiver portion of the gun into the trunnion walls to swingably support the gun for elevational adjustments, as indicated by arrow 26 in FIG. 1. Motor mechanisms, not shown, are provided for powering the basket and weapon, to thus train the weapon on enemy targets. The weapon may be a 120 mm gun or any future tank gun having a breech 28 swingable on pins 30 in the receiver to enable individual rounds of ammunition to be fed into the firing chamber. In the drawing, individual rounds are referenced by numeral 32.

Figure 3:
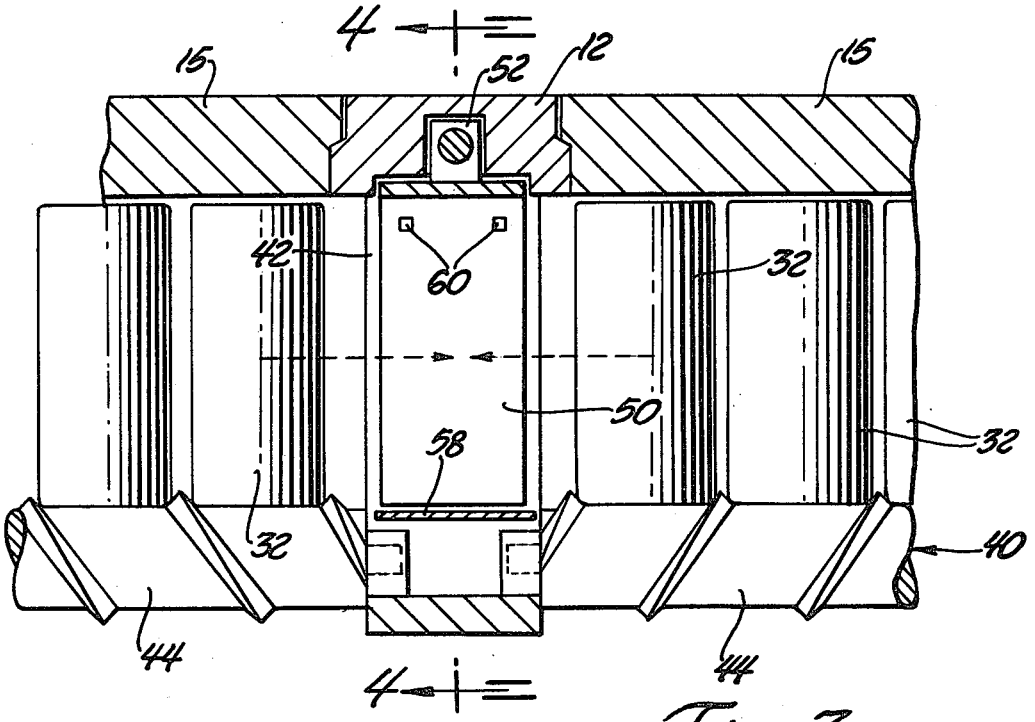
FIG. 3 is an enlarged sectional view on line 3—3 in FIG. 1.

Individual rounds of ammunition are stored upright in two magazines 34 and 36 (FIG. 2) located within hull 10 rearwardly of basket 16. Each magazine may provide storage space for twenty rounds (or more), depending on vehicle size, ammo round dimensions and other factors. As seen in FIG. 2, there are five rows of ammunition in each magazine, each row being separated from adjacent rows by a wall or partition 38. These partitions support the individual rounds against tip-over or other undesired motion; they also provide enhanced fratricide protection against the possibility of undesired detonation of rounds in the magazine. A conveyor means 40 is provided to move the rounds in each row toward a central corridor 42 that separates the two magazines 34 and 36. As best seen in FIG. 3, each conveyor comprises a motor-driven screw 44 (or any mover system) that acts to sequentially advance rounds 32 into a round transfer mechanism 50 located in corridor 42. Each screw 44 also acts to support the weight of the rounds thereon. The rounds are shown as cylindrical components. In actuality each round may be of the telescoped type, comprised of a cylindrical case, internal projectile assembly surrounded by propellant, and igniter means at one end. The system described also can be used for conventional signal piece or two piece ammunitions.

Figure 4:
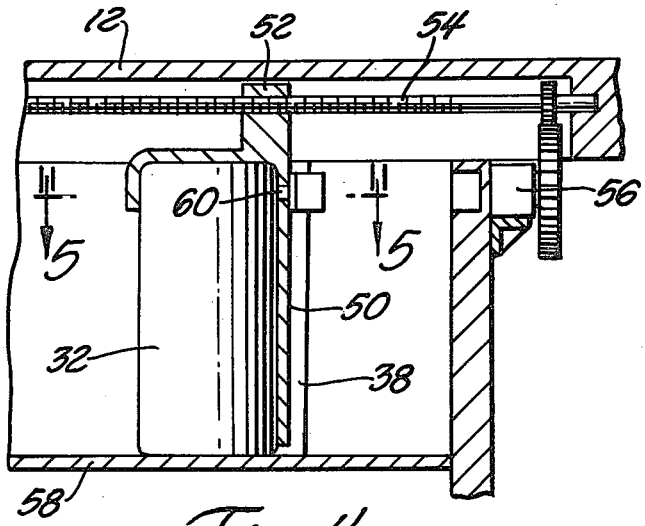
FIG. 4 is a sectional view on line 4—4 in FIG. 3.
Figure 5:
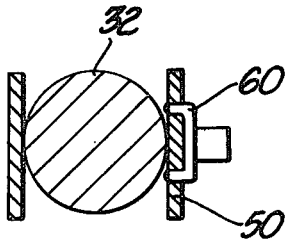
FIG. 5 is a sectional view on line 5—5 in FIG. 4.

Mechanism 50 is illustrated as an inverted L-shaped wall structure suspended from a nut 52 that is adapted to travel along an overhead screw 54; a smaller motor 56 (FIG. 4) drives the screw. The L-shaped wall structure pushes the retained round along corridor 42 toward basket 16. A stationary floor 58 supports the weight of the individual round. Solenoid-actuated prong means 60 may be provided on mechansim 50 to preclude inadvertent lateral dislodgement of the retained round while the mechanism is transferring the round along floor 58. As best seen in FIG. 2, a slidable closure 39 may be provided on the left end wall of magazine 34 to intermittently isolate the stored rounds in magazines 34 and 36 from humans located in basket 16 or in forward areas of the hull. A motor, not shown, would operate closure 39 to a position closing corridor 42 except when mechanism 50 is in the process of delivering a round of ammunition to an arcuately movable carrier 62. Closure 39 provides enhanced fratricide protection.

Figure 6:
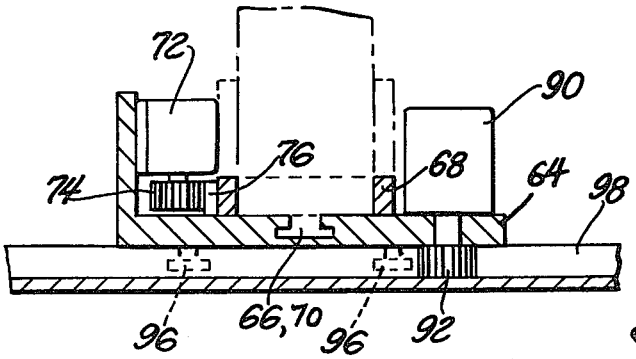
FIG. 6 is a sectional view on line 6—6 in FIG. 7.

When a round of ammunition reaches position **32*b* (FIG. 7) it is no longer supported by floor 58. Consequently the round drops downwardly into a round carrier 62. Carrier 62 includes a flat base member 64 having a T-cross sectioned guideway 66 (FIG. 6) in its upper face for slidably accommodating a slide member 70 that depends from a U-shaped pusher plate 68. With round 32 supported on the upper surface of base member 64, pusher plate 68 can be moved leftwardly (FIG. 7) to transfer the round to position 32*c*. A motor 72 (FIGS. 6 and 8) drives pinion gear 74 that engages rack teeth 76 on a side surface of plate 68, thereby accomplishing the round transfer operation. Thereafter motor 72 is reversed to return plate 68 to its FIG. 7** position ready for the next round.

The transferred round automatically drops from position **32*c* into a cup-shaped rammer 78 carried by a nut 80. Operation of the associated screw 82 by motor 85 (FIG. 1) moves the rammer upwardly through an opening 19 in basket top wall 17. Final thrust of the round into the weapon firing chamber may be accomplished by pusher pin 83 of fluid cylinder pusher mechanism 84**.

It should be noted that basket 16 will at times be rotating around its central axis 18, e.g., when the human gunner is tracking a target. At such times the rammer will not be located on the hull longitudinal centerline. Therefore, it is necessary that carrier 62 be capable of independently moving around the basket to alternately align with rammer 78 and/or transfer mechanism 50.

Figure 8:
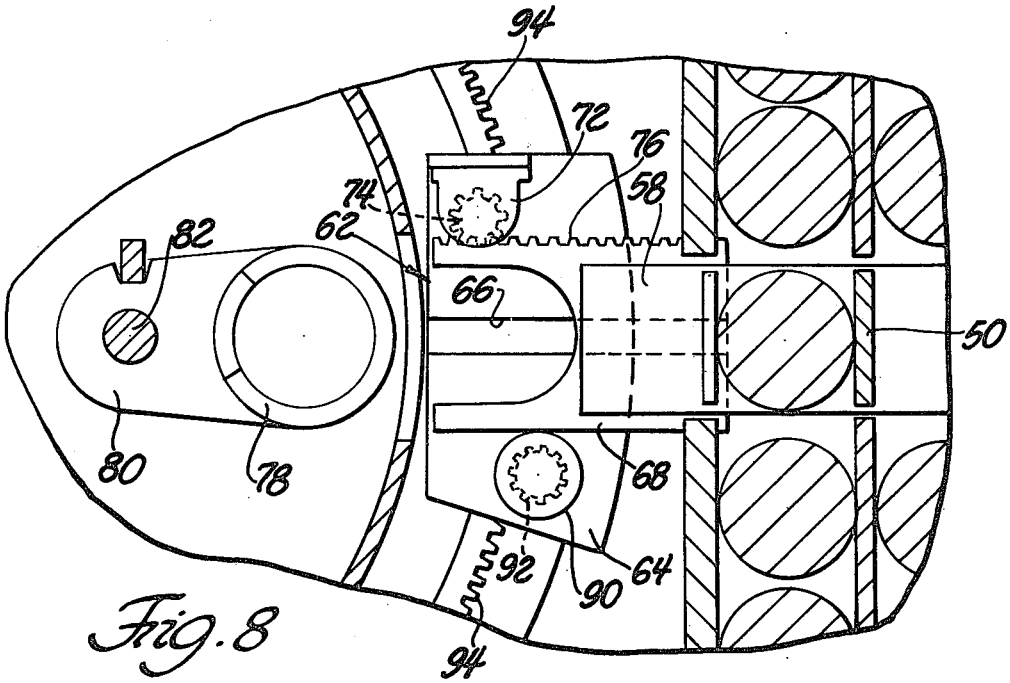
FIGS. 7 and 8 are fragmentary enlarged sectional views of structures shown in FIGS. 1 and 2.
Figure 7:
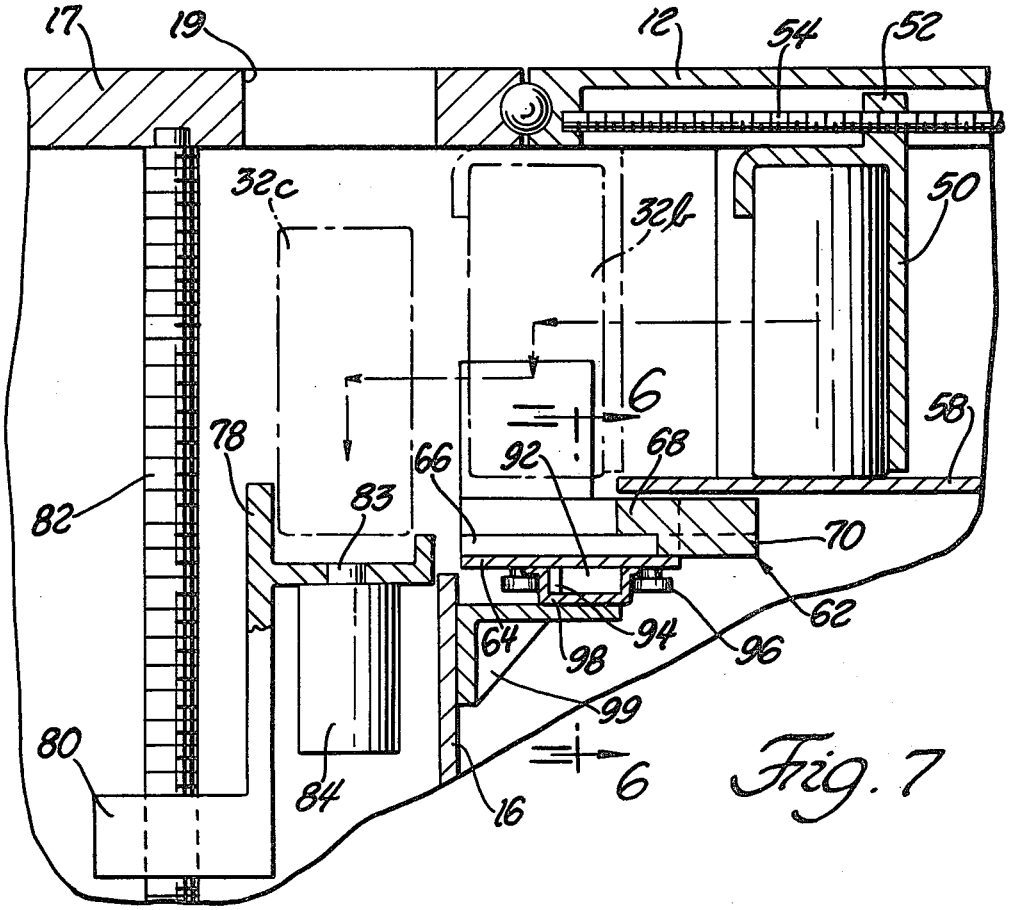

When it is intended that carrier 62 receive a round from mechanism 50 the carrier will be moved to its FIG. 8 receiving position on the hull longitudinal centerline. When it is intended that carrier 62 discharge a round onto rammer 78 the carrier will be moved into radial alignment with the rammer. The track means for supporting carrier 62 may be stationary or it may be attached to basket 16. As shown in FIG. 7 the arcuate supporting track structure 98 is attached to basket 16 by means of brackets 99.

Arcuate travel of carrier 62 along the outer surface of basket 16 may be accomplished by a motor 90 mounted on base member 64. Motor 90 drives a pinion gear 92 that engages an arcuate toothed rack 94 suitably attached to track structure 98. Four guide rollers 96 depend from member 64 to guide member 64 along the arcuate track structure 98 associated with rack 94. The track structure extends through an arc of about 220 degrees around the basket; if the weapon is oriented at any point within this arc the carrier 62 can track the weapon to radially align with rammer 78. When the carrier and rammer 78 are radially aligned motor 72 can be operated to cause pusher member 68 to transfer a round to position 32*c* (FIG. 7).

The tracking motor 90 can be controlled by a nonillustrated sensing means adapted to keep the motor operating until carrier 62 is aligned with the rammer or transfer mechanism 50. The tracking scheme obviates the need for basket 16 and weapon 20 to return to the FIG. 2 straight-ahead position in order to reload the weapon. The weapon can be reloaded while the weapon is moving in the azimuth plane. Tracking motor 90 can be controlled by limit switches on floor 58 and a point on track structure 98 radially aligned with rammer 78. Overall programming of the round transfer mechanism will be controlled by computer system tied into the weapon conrol mechanism.

FIG. 9 illustrates a variant of the storing-loading mechanism wherein the rounds are stored in a single magazine. The rows of ammunition extend parallel to the longitudinal axis of the vehicle; transfer mechanism 50 is arranged to move laterally across the rows to deliver individual rounds to the carrier 62.

With either the FIG. 2 arrangement or the FIG. 9 arrangement the stored rounds are arranged in upright attitudes a slight distance below the plane of the hull upper wall 12. Rounds are initially loaded into the storage magazines through one or more hatch openings in hull top wall 12. FIG. 3 fragmentarily shows two closures 15 in positions for closing the hatch openings in wall 12; hinge means (not shown) permit the closures to be individually swung up to enable rounds of ammunition to be lowered into the magazines. The undersurfaces of closures 15 are preferably in the same plane as the undersurface of wall 12 to act as guide surfaces for rounds 32 as they move toward corridor 42.

When the rounds of ammunition are stored within the hull, as shown in FIGS. 2 and 9, it is possible to store more rounds than when the rounds are stored in the basket. Also, space is then available to station a human gunner in the basket, as shown in FIG. 1. The rammer is located behind the gunner's seat 11 in a noninterferring position. Storage of the ammunition in the hull is also advantageous in that the total weight of the rounds does not encumber the basket motion; slightly greater weapon slewing rates are achieved for a given slew motor system. Another advantage achieved by storing the ammunition in the hull is the fact that humans within the tank can be at least partially protected from inadvertent or undesired detonation of the stored rounds. The front and rear walls of the storage magazines can be formed of thickened armor plate, and the magazine closures 15 (FIG. 3) can include or be provided with blowout plates for venting the blast effects upwardly out of the hull, rather than toward the humans in the basket or in forward areas of the hull.

The patents believed to be of greatest pertinence to this invention are U.S. Pat. Nos. 3,721,156 to Schallehn and 4,313,363 to Schreckenberg.

I wish it to be understood that I do not desire to be limited to the exact details of construction shown and described for obvious modifications will occur to a person skilled in the art.

I claim:

1. In a military vehicle comprising a hull having a longitudinal centerline, a circulr basket located in the hull for powered rotary motion in the azimuth direction, and an external weapon mounted atop the basket in the space above the hull: the improvement comprising means for storing individual rounds of ammunition within the hull outside the basket; said ammunition storing means comprising structure operable to position the stored rounds in parallel rows, with each stored round assuming an upright attitude; a carrier for an individual round movable outside and along the basket perimeter in arc centered on the basket rotational axis; first mechanical means for transferring individual rounds of ammunition from the ammunition storing means to the carrier when the carrier is stationed on the hull longitudinal centerline; said first mechanical transfer means being constructed so that the round is maintained in an upright attitude while it is being moved from the storing means into the carrier; a mechanical round rammer movably located within the basket for upward motion to insert an individual round into the weapon; and second mechanical means for transferring an individual round from the carrier to the rammer; said second mechanical transfer means being constructed to maintain the round in an upright attitude while it is being moved from the carrier into the rammer; said basket and carrier being independently rotatable; said second mechanical transfer means being movable on a radial line through the basket rotational axis, whereby the second transfer means is able to transfer an individual round of ammunition from the carrier into the rammer when the basket is in a variety of different rotated positions.

2. The improvement of claim 1: said ammunition storing means comprising two separate magazines on each side of the hull longitudinal center line; each magazine comprising a plurality of upright partitions operable to position the stored rounds in rows normal to the hull longitudinal centerline; said rows communicating with a central corridor extending along the hull centerline; said first transfer means being movably positioned in the corridor for transferring individual rounds of ammunition from a selected row to the aforementioned carrier.

3. The improvement of claim 2: each magazine including individual round conveyors in each row for selectively moving the ammunition in each row toward the central corridor, to thereby deliver selected rounds to the first transfer means.

4. The improvement of claim 3 wherein the stored rounds are located below a hull upper wall in close proximity to the wall undersurface; said upper wall having two hatch openings therethrough for loading rounds of ammunition into the separate magazines, and an armored closure in each opening.

5. The improvement of claim 4, and further comprising a gunner's seat within the basket, said seat facing away from the mechanical rammer so that when the gunner is facing forwardly the rammer will be behind him on the hull longitudinal centerline.

6. The improvement of claim 5 wherein the second transfer means comprises a powered pusher member (68) slidably positioned on the carrier for motion along a radial line measured from the basket rotational axis.

7. The improvement of claim 6 wherein the first transfer means is movably arranged in the aforementioned corridor to move a round of ammunition to a discharge position above the pusher member, whereupon the round is allowed to move downwardly into the pusher member for subsequent transfer to the rammer.

* * * * *